US011139577B2

(12) United States Patent
Tseng et al.

(10) Patent No.: US 11,139,577 B2
(45) Date of Patent: Oct. 5, 2021

(54) WIRELESS ELECTRONIC DEVICE

(71) Applicant: Acer Incorporated, New Taipei (TW)

(72) Inventors: Yung-Sheng Tseng, New Taipei (TW); Huei-Chun Yang, New Taipei (TW); Chung-Hsuan Tsai, New Taipei (TW)

(73) Assignee: Acer Incorporated, New Taipei (TW)

( * ) Notice: Subject to any disclaimer, the term of this patent is extended or adjusted under 35 U.S.C. 154(b) by 399 days.

(21) Appl. No.: 16/203,630

(22) Filed: Nov. 29, 2018

(65) Prior Publication Data

US 2019/0173188 A1 Jun. 6, 2019

(30) Foreign Application Priority Data

Dec. 6, 2017 (TW) ..... 106142766

(51) Int. Cl.

| | |
|---|---|
| ***H01Q 11/14*** | (2006.01) |
| ***H01Q 9/30*** | (2006.01) |
| ***H01Q 5/335*** | (2015.01) |
| ***H01Q 1/50*** | (2006.01) |
| ***H01Q 21/28*** | (2006.01) |
| ***H01Q 9/42*** | (2006.01) |

(52) U.S. Cl.

CPC ..... *H01Q 11/14* (2013.01); *H01Q 1/50* (2013.01); *H01Q 5/335* (2015.01); *H01Q 9/30* (2013.01); *H01Q 9/42* (2013.01); *H01Q 21/28* (2013.01)

(58) Field of Classification Search

CPC ..... H01Q 11/14; H01Q 5/335; H01Q 5/342; H01Q 5/378; H01Q 5/385; H01Q 5/392; H01Q 5/50; H01Q 1/48; H01Q 1/50; H01Q 9/30; H01Q 21/28

See application file for complete search history.

(56) References Cited

U.S. PATENT DOCUMENTS

| | | | | |
|---|---|---|---|---|
| 6,765,536 | B2 | 7/2004 | Phillips et al. | |
| 9,698,470 | B2 * | 7/2017 | Zhao | H01Q 1/48 |
| 2004/0248523 | A1 | 12/2004 | Nishimura et al. | |
| 2008/0007468 | A1 * | 1/2008 | Sato | H01Q 1/243 343/702 |
| 2010/0214175 | A1 * | 8/2010 | Hui | H01Q 1/521 343/700 MS |

(Continued)

FOREIGN PATENT DOCUMENTS

| | | |
|---|---|---|
| CN | 202206437 | 4/2012 |
| CN | 104332706 | 2/2015 |

(Continued)

*Primary Examiner* — Dameon E Levi
*Assistant Examiner* — Jennifer F Hu
(74) *Attorney, Agent, or Firm* — JCIPRNET

(57) ABSTRACT

A wireless electronic device includes a ground plane, a first antenna element, a first extension element, a first switching element and a plurality of impedance elements. The ground plane includes a first edge and a second edge opposite to each other. The first antenna element is adjacent to the first edge. The first extension element is adjacent to the second edge. The first switching element is electrically connected to the first extension element. The plurality of impedance elements are electrically connected between the first switching element and a ground. The first switching element connects the first extension element to one of the plurality of impedance elements in response to an operation frequency band of the first antenna element.

7 Claims, 3 Drawing Sheets

(56) References Cited

U.S. PATENT DOCUMENTS

| | | | | |
|---|---|---|---|---|
| 2012/0139813 | A1 | 6/2012 | Anguera et al. | |
| 2016/0064820 | A1 | 3/2016 | Kim et al. | |
| 2016/0134010 | A1 | 5/2016 | Yan | |
| 2016/0352014 | A1* | 12/2016 | Chen | H01Q 5/328 |

FOREIGN PATENT DOCUMENTS

| | | |
|---|---|---|
| CN | 104901012 | 9/2015 |
| CN | 104953234 | 9/2015 |
| CN | 107331969 | 11/2017 |
| TW | I583057 | 5/2017 |
| WO | 2015074251 | 5/2015 |

* cited by examiner

WIRELESS ELECTRONIC DEVICE

CROSS-REFERENCE TO RELATED APPLICATION

This application claims the priority benefit of Taiwan application serial no. 106142766, filed on Dec. 6, 2017. The entirety of the above-mentioned patent application is hereby incorporated by reference herein and made a part of this specification.

BACKGROUND

Field of the Invention

The invention relates to a wireless electronic device and more particularly, to a wireless electronic device including antenna elements and extension elements.

Description of Related Art

With the advent of the Internet of Beings (IoB) era, various kinds of wireless electronic devices (for example, pet tracers and air monitors) are correspondingly produced. Generally, in order to increase radiation characteristics of an antenna element in a wireless electronic device, an equivalent length of a ground plane required by the wireless electronic device is approximately ¼ of a wavelength of a resonance frequency of the antenna element. However, under the design requirement for miniaturization, the wireless electronic device is usually unable to satisfy grounding demands of the antenna element in various frequency bands. For example, for a pet tracer operating in a GSM850 band, ¼ the wavelength of the resonance frequency (e.g., 850 MHz) of the antenna element is about 88 mm. However, as a size of the pet tracer is about 40×50×10 $mm^3$, a maximum length (i.e., 50 mm) of a ground plane of the pet tracer is usually shorter than the length of ¼ the wavelength of the resonance frequency (which is 88 mm), and as a result, the pet tracer is unable to satisfy the grounding demand of the antenna element, which leads to reduction of radiation characteristics of the antenna element in the

SUMMARY

The invention provides a wireless electronic device capable of electrically connecting a first extension element to a ground plane through one of a plurality of impedance elements by means of the switching of a first switching element. In this way, radiation characteristics of the first antenna element in a plurality of frequency bands can be increased.

A wireless electronic device of the invention includes a ground plane, a first antenna element, a first extension element, a first switching element and a plurality of impedance elements. The ground plane includes a first edge and a second edge opposite to each other. The first antenna element is adjacent to the first edge. The first extension element is adjacent to the second edge. The first switching element is electrically connected to the first extension element. The plurality of impedance elements are electrically connected between the first switching element and a ground. The first switching element connects the first extension element to one of the plurality of impedance elements in response to an operation frequency band of the first antenna element.

In an embodiment of the invention, when the first antenna element operates in a first frequency band, the first extension element is electrically connected to a first impedance element among the plurality of impedance elements through the first switching element, and the first extension element and the first impedance element are employed to increase radiation characteristics of the first antenna element in the first frequency band.

In an embodiment of the invention, when the first antenna element operates in a second frequency band, the first extension element is electrically connected to a second impedance element among the plurality of impedance elements through the first switching element, and the first extension element and the second impedance element are employed to increase radiation characteristics of the first antenna element in the second frequency band.

To sum up, in the wireless electronic device of the invention, the first switching element can connect the first extension element to one of the plurality of impedance elements in response to the operation frequency band of the first antenna element. Thereby, the wireless electronic device can increase the radiation characteristics of the first antenna element in the plurality of bands by using the first extension element and the plurality of impedance elements.

In order to make the aforementioned and other features and advantages of the invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
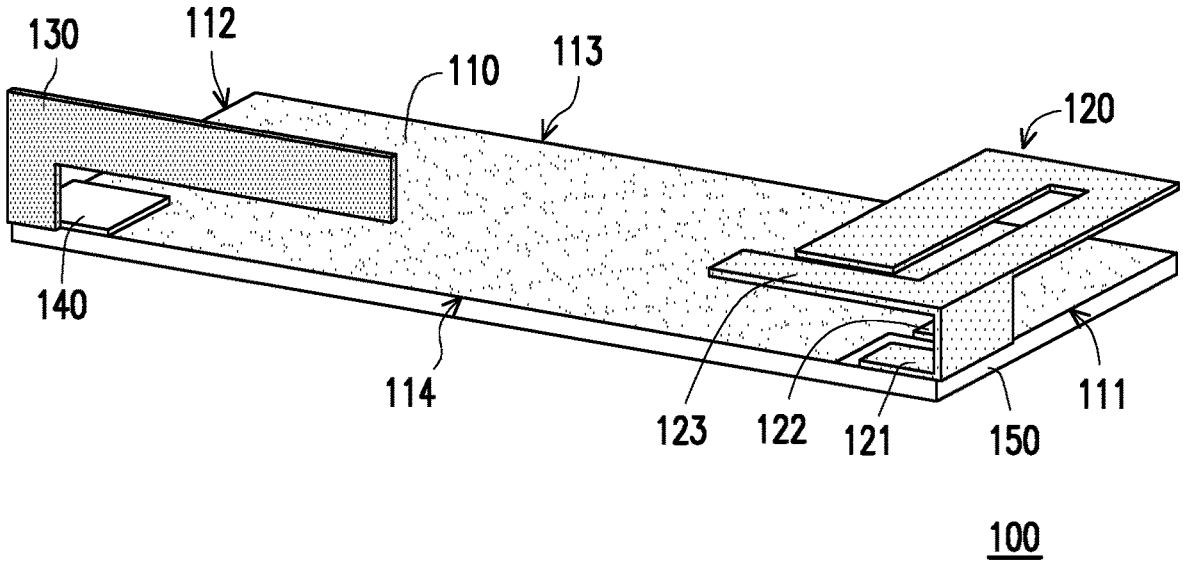
FIG. 1 is a schematic diagram illustrating a wireless electronic device according to an embodiment of the present invention.
Figure 2:
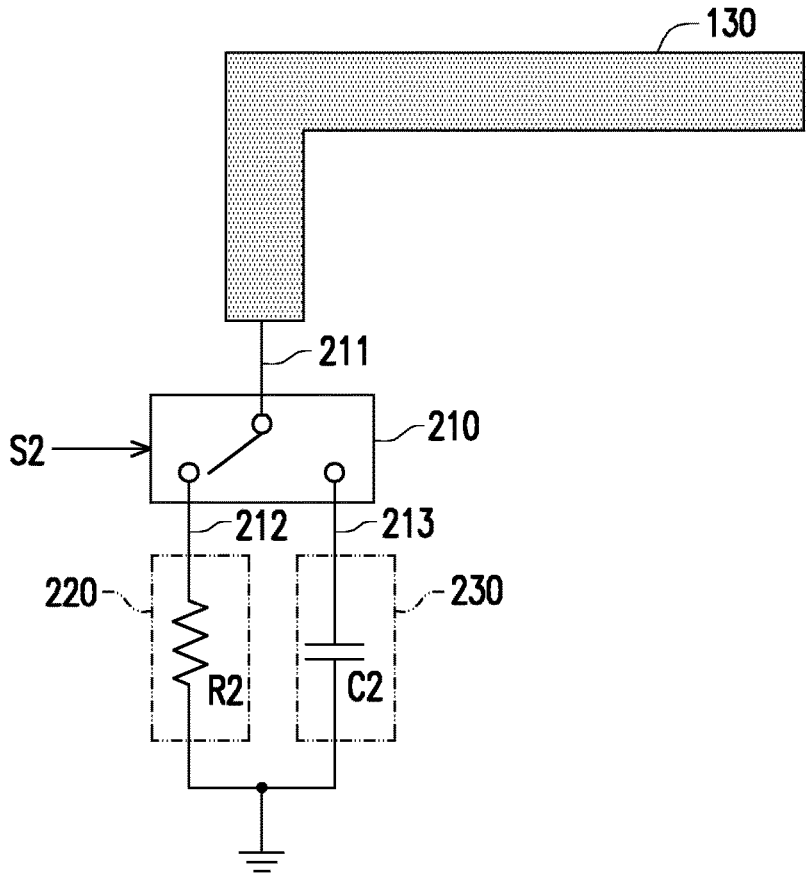
FIG. 2 is a schematic diagram illustrating a first extension element and an electronic circuit depicted in FIG. 1.

FIG. 1 is a schematic diagram illustrating a wireless electronic device according to an embodiment of the present invention, and FIG. 2 is a schematic diagram illustrating a first extension element and an electronic circuit depicted in FIG. 1. Referring to FIG. 1, a wireless electronic device 100 includes a ground plane 110, a first antenna element 120, a first extension element 130, an electronic circuit 140 and a substrate 150, and referring to FIG. 2, the electronic circuit 140 includes a first switching element 210, a plurality of impedance elements (for example, including a first impedance element 220 and a second impedance element 230). The ground plane 110 is disposed on the substrate 150 and includes a first to a fourth edges 111 to 114. The first edge 111 is opposite to the second edge 112. The third edge 113 and the fourth edge 114 are opposite to each other and located between the first edge 111 and the second edge 112.

In an overall disposition, the first antenna element 120 is adjacent to the first edge 111 of the ground plane 110. The first extension element 130 is adjacent to the second edge 112 of the ground plane 110. In other words, the first antenna element 120 and the first extension element 130 are located at two opposite sides of the ground plane 110. Additionally, both the first antenna element 120 and the first extension element 130 are adjacent to the fourth edge of the ground plane 110. On the other hand, the plurality of impedance elements (e.g., the first impedance element 220 and the second impedance element 230) are electrically connected between the first switching element 210 and the ground, and the ground is electrically connected with the ground plane 110.

In operation, the first switching element 210 may connect the first extension element 130 to one of the plurality of impedance elements in response to an operation frequency band of the first antenna element 120. Thereby, the first extension element 130 may employ different impedance elements to form resonance paths having different equivalent lengths, so as to compensate an equivalent length of the ground plane 110 according to an operation frequency band of the first antenna element 120. In this way, the wireless electronic device 100 may adjust radiation characteristics (e.g., a radiation efficiency and an operation frequency bandwidth) of the first antenna element 120 in different operation frequency bands, so as to increase the radiation characteristics of the first antenna element 120 in different operation frequency bands.

For example, referring to FIG. 2, the first switching element 210 includes a first to a third pins 211 to 213, and the first switching element 210 is controlled by first control information S2. Additionally, in the embodiment illustrated in FIG. 1, the first antenna element 120 may cover or operate in a first frequency band and a second frequency band. Specifically, the first antenna element 120 may be, for example, an inverted-F antenna and includes a feeding portion 121, a short-circuit portion 122 and a radiation portion 123. Therein, the radiation portion 123 is electrically connected to the short-circuit portion 122 and the feeding portion 121, and the short-circuit portion 122 is electrically connected to the ground plane 110. The feeding portion 121 and the radiation portion 123 may form a first and a second resonance paths. The first antenna element 120 may operate in the first frequency band through the first resonance path and operate in the second frequency band through the second resonance path. Even though FIG. 1 illustrates an implementation type of the first antenna element 120 for example, it construes no limitations to the invention. For example, the first antenna element 120 may also be a monopole antenna, a plane inverted-F antenna or any other type of antenna.

When the first antenna element 120 operates in the first frequency band, i.e., when the first antenna element 120 has a first resonance frequency, the first switching element 210 may electrically connect the first pin 211 to the second pin 212 according to the first control information S2. In this circumstance, the first extension element 130 may be electrically connected to the first impedance element 220 through the first switching element 210. Thereby, the first extension element 130 and the first impedance element 220 may be employed to extend or adjust the equivalent length of the ground plane 110, so as to increase the radiation characteristics of the first antenna element 120 in the first frequency band. For example, the first extension element 130, the first impedance element 220 and the ground plane 110 may form at least one resonance path, and a length of the resonance path may be approximately ¼ of a wavelength of the first resonance frequency. In other words, the wireless electronic device 100 may satisfy a grounding demand of the first antenna element 120 in the first frequency band by using the first extension element 130 and the first impedance element 220, so as to increase the radiation characteristics of the first antenna element 120 in the first frequency band.

When the first antenna element 120 operates in the second frequency band, i.e., when the first antenna element 120 has a second resonance frequency, the first switching element 210 may electrically connect the first pin 211 to the third pin 213 according to the first control information S2. In this circumstance, the first extension element 130 may be electrically connected to the second impedance element 230 through the first switching element 210. Thereby, the first extension element 130 and the second impedance element 230 may be employed to extend or adjust the equivalent length of the ground plane 110, so as to increase the radiation characteristics of the first antenna element 120 in the second frequency band. For example, the first extension element 130, the second impedance element 230 and the ground plane 110 may form at least one resonance path, and a length of the resonance path may be approximately ¼ of a wavelength of the second resonance frequency. In other words, the wireless electronic device 100 may satisfy a grounding demand of the first antenna element 120 in the second frequency band by using the first extension element 130 and the second impedance element 230, so as to increase the radiation characteristics of the first antenna element 120 in the second frequency band.

Figure 3:
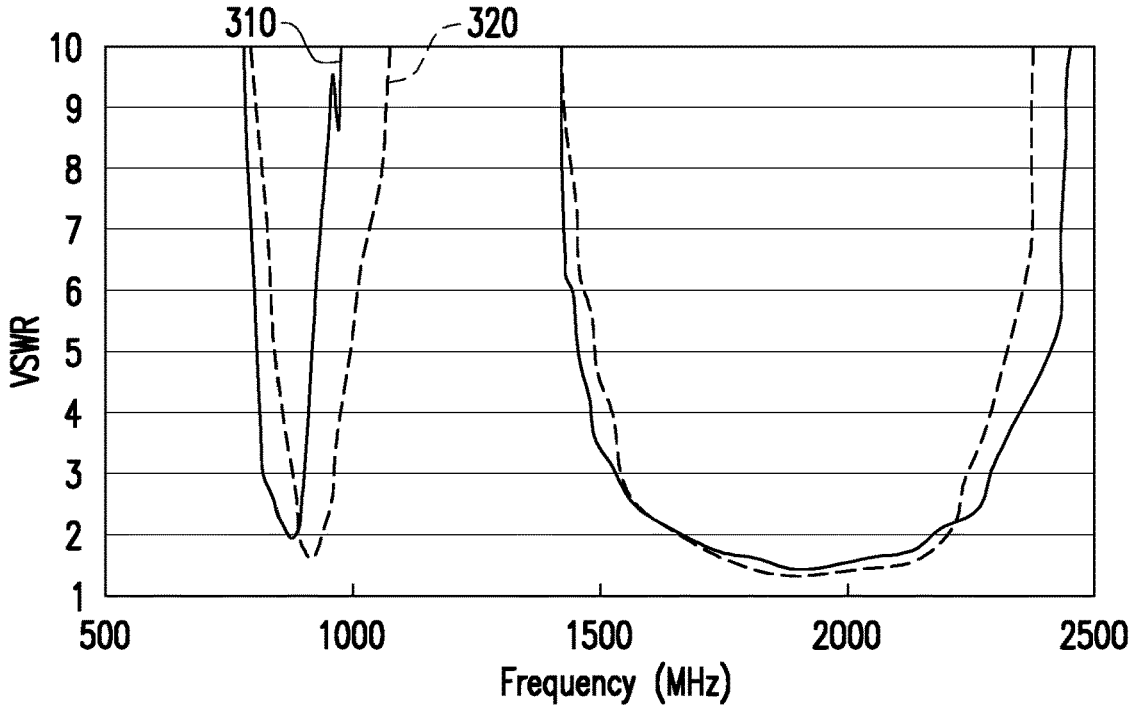
FIG. 3 is a schematic diagram illustrating voltage standing wave ratios (VSWRs) of the first antenna element according to an embodiment of the present invention.

Furthermore, a frequency of the first frequency band (e.g., a GSM850 band) is less than a frequency of the second frequency band (e.g., a GSM900 band), the first impedance element 220 may be a 0 ohm resistor R2, and the second impedance element 230 may be a capacitor C2. For example, FIG. 3 is a schematic diagram illustrating voltage standing wave ratios (VSWRs) of the first antenna element according to an embodiment of the present invention, wherein a curve 310 represents a VSWR of the first antenna element 120 when the first switching element 210 is in a first state, and a curve 320 represents a VSWR of the first antenna element 120 when the first switching element 210 is in a second state.

Referring to the curve 310, when the first switching element 210 is switched to the first state, i.e., when the first pin 211 and the second pin 212 of the first switching element 210 are electrically connected with each other, the first antenna element 120 may cover the first frequency band (e.g., the GSM850 band) and a frequency-doubling band of the first frequency band. Additionally, the first antenna element 120 in the first frequency band (e.g., the GSM850 band) may reach an antenna efficiency of −8.51 dBi. It should be noted that in a scenario that the first switching element 210 and the plurality of impedance elements are not disposed, an antenna efficiency of the first antenna element 120 in the first frequency band (e.g., the GSM850 band) is about −12.71 dBi. In other words, the antenna efficiency of the first antenna element 120 in the first frequency band (e.g., the GSM850 band) may be increased by 4.2 dBi by the first extension element 130 and the first impedance element 220.

Referring to the curve 320, when the first switching element 210 is switched to the second state, i.e., when the first pin 211 and the third pin 213 of the first switching element 210 are electrically connected with each other, the first antenna element 120 may cover the second frequency band (e.g., the GSM900 band) and a frequency-doubling band of the second frequency band. Additionally, the first antenna element 120 in the second frequency band (e.g., the GSM900 band) may reach an antenna efficiency of −7.81 dBi. It should be noted that in a scenario that the first switching element 210 and the plurality of impedance elements are not disposed, an antenna efficiency of the first antenna element 120 in the second frequency band (e.g., the GSM900 band) is about −15.7 dBi. In other words, the antenna efficiency of the first antenna element 120 in the second frequency band (e.g., the GSM900 band) may be increased by 7.89 dBi by the first extension element 130 and the second impedance element 230.

Figure 4:
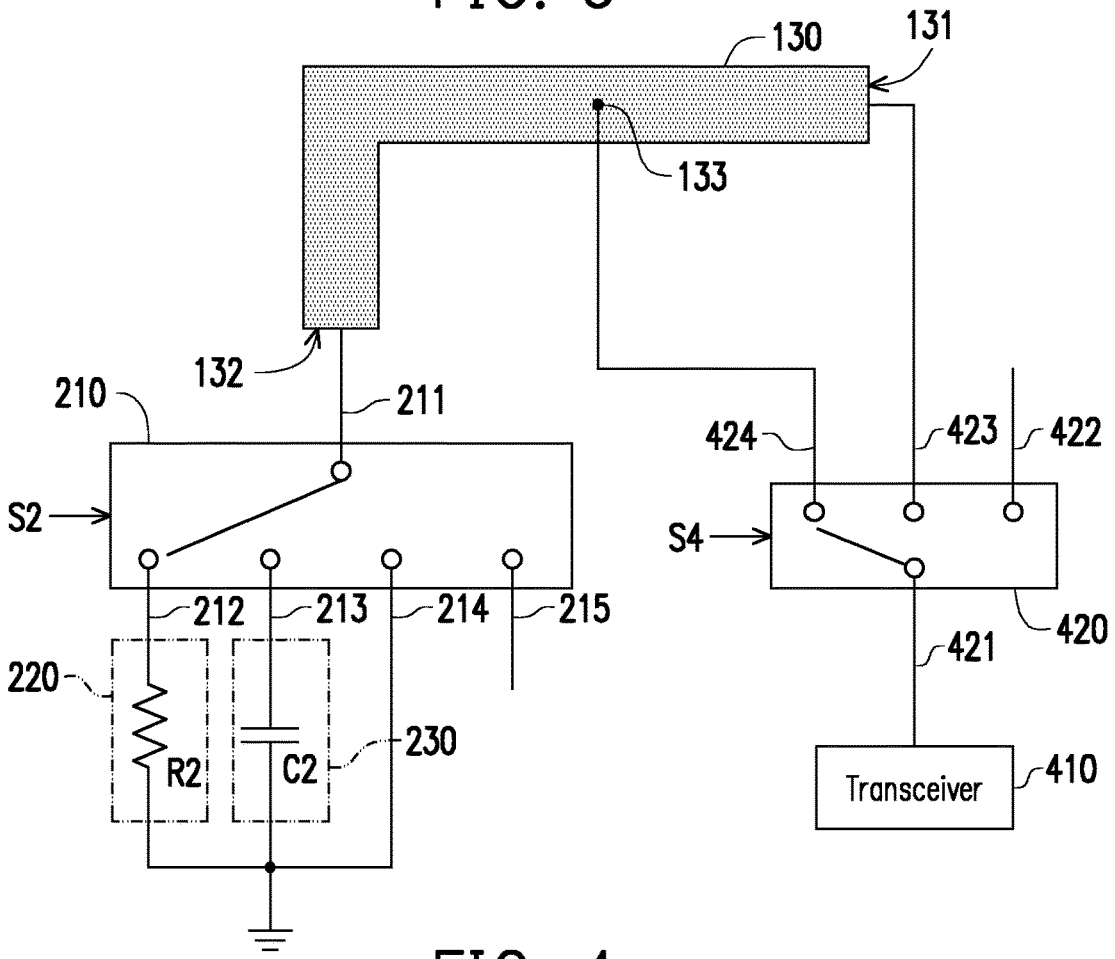
FIG. 4 is another schematic diagram illustrating the first extension element and the electronic circuit depicted in FIG. 1.

It is to be mentioned that the first extension element 130 may also be provided with an antenna function. For example, FIG. 4 is another schematic diagram illustrating the first extension element and the electronic circuit depicted in FIG. 1. Referring to FIG. 4, the electronic circuit 140 in the wireless electronic device 110 further includes a transceiver 410 and a second switching element 420, and the first switching element 210 further includes a fourth pin 214 and a fifth pin 215.

Specifically, the second switching element 420 is controlled by second control information S4 and includes a first to a fourth pins 421 to 424. The first pin 421 is electrically connected to the transceiver 410. The second pin 422 is in a floating state. The third pin 423 is electrically connected to a first terminal 131 of the first extension element 130. The fourth pin 424 is electrically connected to a feeding point 133 of the first extension element 130. The feeding point 133 is located between the first terminal 131 and a second terminal 132 of the first extension element 130. On the other hand, the fourth pin 214 of the first switching element 210 is electrically connected to the ground, and the fifth pin 215 of the first switching element 210 is in a floating state.

In operation, when the first antenna element 120 operates in the first frequency band or the second frequency band, the second switching element 420 may electrically connect the first pin 421 to the second pin 422 according to the second control information S4. In this circumstance, the first switching element 210 may electrically connect the first pin 211 to the second pin 212 or the third pin 213 according to the first control information S2, such that the first extension element 130 may be employed to compensate grounding demands of the first antenna element 120 in the first frequency band and the second frequency band. On the other hand, when the first antenna element 120 does not operate in the first frequency band and the second frequency band, the first switching element 210 may connect the second terminal 132 of the first extension element 130 to the ground or maintain it in the floating state according to the first control information S2, and the second switching element 420 may electrically connect the first pin 421 to the third pin 423 or the fourth pin 424 according to the second control information S4. Thereby, the first extension element 130 may have different antenna structures for receiving or emitting electromagnetic waves.

For example, the first switching element 210 may electrically connect the first pin 211 to the fourth pin 214 or the fifth pin 215 according to the first control information S2, so as to electrically connect the second terminal 132 of the first extension element 130 to the ground or maintain it in the floating state. When the second terminal 132 of the first extension element 130 is maintained in the floating state through the first switching element 210, and the first pin 421 and the third pin 423 of the second switching element 420 are electrically connected with each other, the first extension element 130 has a monopole antenna structure, and the transceiver 410 may transmit a feeding signal to the first terminal 131 of the first extension element 130 through the second switching element 420.

When the second terminal 132 of the first extension element 130 is electrically connected to the ground through the first switching element 210, and the first pin 421 and the third pin 423 of the second switching element 420 are electrically connected with each other, the first extension element 130 has a loop antenna structure, and the transceiver 410 may transmit the feeding signal to the first terminal 131 of the first extension element 130 through the second switching element 420. When the second terminal 132 of the first extension element 130 is electrically connected to the ground through the first switching element 210, and the first pin 421 and the fourth pin 424 of the second switching element 420 are electrically connected with each other, the first extension element 130 has an inverted-F antenna structure, and the transceiver 410 may transmit the feeding signal to the feeding point 133 of the first extension element 130 through the second switching element 420.

It is to be mentioned that in another embodiment, the first antenna element 120 may cover not only the first frequency band and the second frequency band, but also other bands. Additionally, the wireless electronic device 100, besides compensating the grounding demands of the first antenna element 120 in the first frequency band and the second frequency band by using the first extension element 130, may also compensate grounding demands of the first antenna element 120 in other frequency bands by using other extension elements and/or antenna elements.

Figure 5:
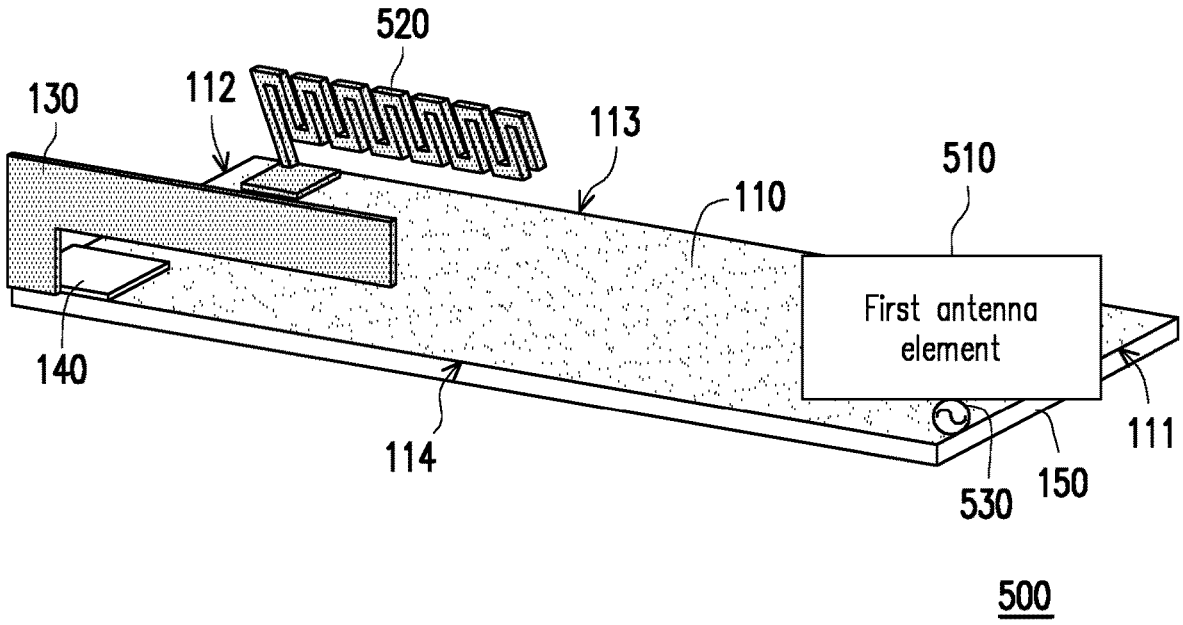
FIG. 5 is a schematic diagram illustrating a wireless electronic device according to another embodiment of the present invention.

For example, FIG. 5 is a schematic diagram illustrating a wireless electronic device according to another embodiment of the present invention. In comparison with the embodiment illustrated in FIG. 1, a first antenna element 510 of a wireless electronic device 500 illustrated in FIG. 5 may further operate in a third band, and the wireless electronic device 500 further includes a second extension element 520.

Specifically, the first antenna element 510 is adjacent to the first edge 111 and the fourth edge 114 of the ground plane 110 and electrically connected to a signal source 530. The second extension element 520 is adjacent to the second edge 112 and the third edge 113 of the ground plane 110 and electrically connected to the ground plane 110. In operation, the first antenna element 510, besides operating in the first frequency band and the second frequency band through the first and the second resonance paths, may further operate in a third band through a third resonance path. Additionally, when the first antenna element 510 operates in the third band, i.e., when the first antenna element 510 has a third resonance frequency, the second impedance element 520 may be employed to extend the equivalent length of the ground plane 110. For example, the second extension element 520 and the ground plane 110 may form at least one resonance path, and a length of the resonance path may be approximately ¼ of a wavelength of the third resonance frequency. Thereby, the second extension element 520 may be employed to adjust and increase radiation characteristics of the first antenna element in the third band.

Being similar to the embodiment illustrated in FIG. 1, the first extension element 130 and the electronic circuit 140 in the wireless electronic device 500 may be similar to those in the embodiment illustrated in FIG. 2 or the embodiment illustrated in FIG. 4. In other words, when the first antenna element 510 operates in the first frequency band or the second frequency band, the wireless electronic device 500 may employ the first extension element 130 to adjust the equivalent length of the ground plane 110, so as to increase the radiation characteristics of the first antenna element 510 in the first frequency band and the second frequency band. Additionally, when the first antenna element 510 does not operate in the first frequency band and the second frequency band, the first extension element 130 may further be provided with an antenna function. The detailed disposition and operation of each element in the embodiment illustrated in FIG. 5 are included in each of the embodiments described above and thus, will not be repeated.

Figure 6:
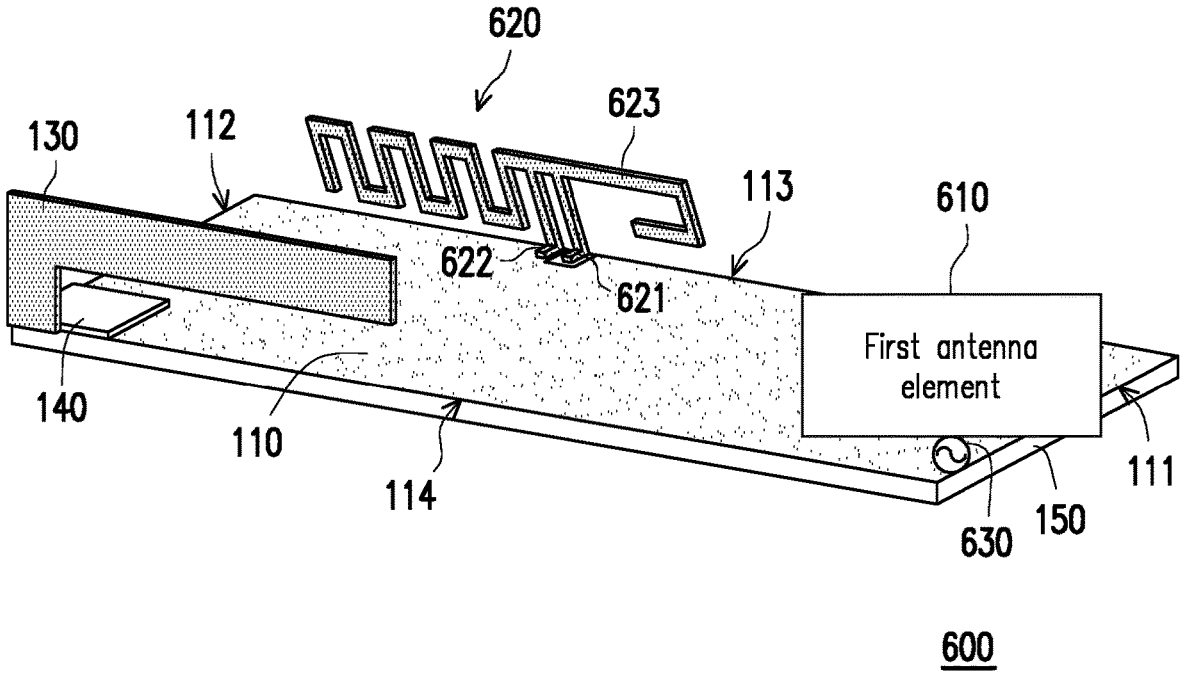
FIG. 6 is a schematic diagram illustrating a wireless electronic device according to yet another embodiment of the present invention.

FIG. 6 is a schematic diagram illustrating a wireless electronic device according to yet another embodiment of the present invention. In comparison with the embodiment illustrated in FIG. 1, a first antenna element 610 of a wireless electronic device 600 illustrated in FIG. 6 may further operate in a third band, and the wireless electronic device 600 further includes a second antenna element 620.

Specifically, the first antenna element 610 is adjacent to the first edge 111 and the fourth edge 114 of the ground plane 110 and electrically connected to a signal source 630. The second antenna element 620 is adjacent to the third edge 113 of the ground plane 110. Additionally, the second antenna element 620 is an inverted-F antenna and includes a feeding portion 621, a short-circuit portion 622 and a radiation portion 623. The radiation portion 623 is electrically connected with the feeding portion 621 and the short-circuit portion 622, and the short-circuit portion 622 is electrically connected to the ground plane 110. In operation, when the first antenna element 610 operates in the third band, i.e., when the first antenna element 610 has a third resonance frequency, the short-circuit portion 622 and the radiation portion 623 in the second antenna element 620 may be employed to extend the equivalent length of the ground plane 110. For example, the short-circuit portion 622, the radiation portion 623 and the ground plane 110 may form at least one resonance path, and a length of the resonance path may be approximately ¼ of a wavelength of the third resonance frequency. Thereby, the short-circuit portion 622 and the radiation portion 623 in the second antenna element 620 may be employed to adjust and increase radiation characteristics of the first antenna element 610 in the third band.

Being similar to the embodiment illustrated in FIG. 1, the first extension element 130 and the electronic circuit 140 in the wireless electronic device 600 may be similar to those of the embodiment illustrated in FIG. 2 or the embodiment illustrated in FIG. 4. In other words, when the first antenna element 610 operates in the first frequency band or the second frequency band, the wireless electronic device 600 may employ the first extension element 130 to adjust the equivalent length of the ground plane 110, so as to increase the radiation characteristics of the first antenna element 610 in the first frequency band and the second frequency band. Additionally, when the first antenna element 610 does not operate in the first frequency band and the second frequency band, the first extension element 130 may further be provided with an antenna function. The detailed disposition and operation of each element in the embodiment illustrated in FIG. 6 is included in each of the embodiments described above and thus, will not be repeated.

In light of the foregoing, in the wireless electronic device of the invention, the first switching element can connect the first extension element to one of the plurality of impedance elements in response to the operation frequency band of the first antenna element. Thereby, when the first antenna element operates in the first frequency band or the second frequency band, the wireless electronic device can increase the radiation characteristics of the first antenna element in the first frequency band and the second frequency band by using the first extension element and the plurality of impedance elements. Additionally, when the first antenna element operates in the third band, the wireless electronic device can increase the radiation characteristics of the first antenna element in the third band further by using the second extension element or the second antenna element. Moreover, the first extension element can not only be employed to extend the equivalent length of the ground plane, but also can further have different antenna structures in response to the switching of the first switching element and the second switching element, so as to be provided with the antenna function.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A wireless electronic device, comprising:

a ground plane, comprising a first edge and a second edge opposite to each other;

a first antenna element, being adjacent to the first edge;

a first extension element, being adjacent to the second edge;

a first switching element, electrically connected to the first extension element;

a plurality of impedance elements, electrically connected between the first switching element and a ground, wherein the first switching element connects the first extension element to one of the plurality of impedance elements in response to an operation frequency band of the first antenna element, wherein when the first antenna element operates in a first frequency band, the first extension element is electrically connected to a first impedance element among the plurality of impedance elements through the first switching element, and the first extension element and the first impedance element are employed to increase radiation characteristics of the first antenna element in the first frequency band, when the first antenna element operates in a second frequency band, the first extension element is electrically connected to a second impedance element among the plurality of impedance elements through the first switching element, and the first extension element and the second impedance element are employed to increase radiation characteristics of the first antenna element in the second frequency band;

a transceiver; and a second switching element, comprising a first pin electrically connected to the transceiver, a second pin in a floating state, a third pin electrically connected to a first terminal of the first extension element and a fourth pin electrically connected to a feeding point of the first extension element, wherein when the first antenna element operates in the first frequency band or the second frequency band, the first pin and the second pin are electrically connected with each other, and when the first antenna element does not operate in the first frequency band and the second frequency band, the first switching element electrically connects a second terminal of the first extension element to the ground or maintains the second terminal of the first extension element in the floating state according to first control information, and the second switching element electrically connects the first pin to the third pin or the fourth pin according to second control information.

2. The wireless electronic device according to claim 1, wherein a frequency of the first frequency band is less than a frequency of the second frequency band, the first impedance element is a resistor, and the second impedance element is a capacitor.

3. The wireless electronic device according to claim 1, wherein when the second terminal of the first extension element is maintained in the floating state, and the first pin and the third pin of the second switching element are electrically connected with each other, the first extension element has a monopole antenna structure.

4. The wireless electronic device according to claim 3, wherein when the second terminal of the first extension element is electrically connected to the ground, and the first pin and the third pin of the second switching element are electrically connected with each other, the first extension element has a loop antenna structure.

5. The wireless electronic device according to claim 4, wherein when the second terminal of the first extension element is electrically connected to the ground, and the first pin and the fourth pin of the second switching element are electrically connected with each other, the first extension element has an inverted-F antenna structure.

6. The wireless electronic device according to claim 1, wherein the ground plane further comprises a third edge located between the first edge and the second edge, and the wireless electronic device further comprises:

a second extension element, being adjacent to the second edge and the third edge, electrically connected to the ground plane and configured to adjust radiation characteristics of the first antenna element in a third band.

7. The wireless electronic device according to claim 1, wherein the ground plane further comprises a third edge located between the first edge and the second edge, and the wireless electronic device further comprises:

a second antenna element, being adjacent to the third edge and comprising a feeding portion, a short-circuit portion and a radiation portion, wherein the radiation portion is electrically connected to the feeding portion and the short-circuit portion, the short-circuit portion is electrically connected to the ground plane, and the short-circuit portion and the radiation portion are configured to adjust radiation characteristics of the first antenna element in a third band.

* * * * *